US006080447A

United States Patent [19]

Ferroni et al.

[11] Patent Number: 6,080,447

[45] Date of Patent: Jun. 27, 2000

[54] LOW ETCH ALKALINE ZINCATE COMPOSITION AND PROCESS FOR ZINCATING ALUMINUM

[75] Inventors: Keith L. Ferroni, Hamden; Patricia A. Cacciatore, Orange; Paul R. Gerst, Oxford, all of Conn.

[73] Assignee: Enthone-OMI, Inc., West Haven, Conn.

[21] Appl. No.: 09/078,921

[22] Filed: May 14, 1998

[51] Int. Cl.[7] ..... B05D 3/02

[52] U.S. Cl. ..... 427/321; 427/131; 427/328; 427/307; 427/406; 106/1.17

[58] Field of Search ..... 427/307, 321, 427/328, 131, 406, 438; 106/1.17; 216/102; 252/79.2

[56] References Cited

U.S. PATENT DOCUMENTS

| | | | |
|---|---|---|---|
| 2,935,425 | 5/1960 | Gutzeit et al. . | |
| 3,216,835 | 11/1965 | Saubestre . | |
| 3,338,726 | 8/1967 | Berzins et al. . | |
| 3,597,266 | 8/1971 | Leibowitz et al. . | |
| 3,717,482 | 2/1973 | Gulla et al. . | |
| 3,915,716 | 10/1975 | Haack . | |
| 3,953,654 | 4/1976 | Feldstein . | |
| 3,982,055 | 9/1976 | Howard | 427/309 |
| 4,018,628 | 4/1977 | Paulet | 148/6.27 |
| 4,226,681 | 10/1980 | Shirahata et al. | 204/38 ST |
| 4,466,233 | 8/1984 | Thesman . | |
| 4,467,067 | 8/1984 | Valayil et al. . | |
| 4,780,342 | 10/1988 | LeBlanc, Jr. . | |
| 5,437,887 | 8/1995 | Yarkosky et al. . | |
| 5,633,115 | 5/1997 | Jaeger et al. | 430/231 |

OTHER PUBLICATIONS

"Immersion Coatings on Aluminum", by D. S. Lashmore, Part 1—*Morphology*, pp. 37–41, AES Research Project 41, Jan. 1980.

"The Role of Iron (III) and Tartrate in the Zincate Immersion Process for Plating Aluminium", by S. G. Robertson and I. M. Ritchie, pp. 799–804, A. J. Parker Cooperative Research Centre for Hydrometallurgy, Murdoch University, Western Australia 6150, received Apr. 22, 1996: revised Jul. 30, 1996.

"Formation of Immersion Zinc Coatings on Aluminum", by W. G. Zelley, pp. 328–333, Aluminum Research Laboratories, Aluminum Company of America, New Kensington, Pennsylvania, vol. 100, No. 7, Paper Delivered Oct. 26–30, Oct. 30, 1952.

"Electroless (Autocatalytic, Chemical) Plating", by Jim Henry, pp. 353–361, Metal Finishing Guidebook and Directory Issue '92. No month available.

*Primary Examiner*—Brian K. Talbot

*Attorney, Agent, or Firm*—DeLio & Peterson LLC; Richard P. Mueller

[57] ABSTRACT

A method is provided for zincating aluminum substrates for metal plating thereon wherein the plated aluminum product has smoothness, dimensional integrity and increased production yield of the plated products. The substrates also have enhanced paramagnetic thermal stability of ENP coatings used on memory disk products. A zincate bath contains as additives $Fe^{+3}$ and $NaNO_3$, and a chelator to chelate the iron, with a preferred iron chelator being Rochelle Salt and with the amount of $Fe^{+3}$ being controlled at a preferred concentration of 0.2 to 0.3 g/l. A preferred zincating method employs an etchant composition comprising $HNO_3$, $H_2S0_4$ and $H_3PO_4$ to etch the aluminum substrate prior to zincating. Use of this etchant composition, either alone or with the zincate bath of the invention, is particularly effective for aluminum substrates which have been ground to a smoothness of less than 100 Å. The etchant is non-aggressive and removes metal oxides formed by the grinding and annealing process to form the aluminum substrates used to fabricate the memory disks. The etchant also preserves the dimensional integrity of the substrate and prepares the surface for zincate deposition. It is highly preferred to use the etchant and zincate bath of the invention in the same metal plating process to provide an enhanced process and metal plated product. The etchant or zincating bath may also be used alone in other plating processes requiring these type substrate treatments.

10 Claims, No Drawings

LOW ETCH ALKALINE ZINCATE COMPOSITION AND PROCESS FOR ZINCATING ALUMINUM

BACKGROUND OF THE INVENTION

1. Field of the Invention

This invention relates to the zincating of aluminum and metal plating of the zincated aluminum and, more particularly, to providing a metal plating pretreatment procedure for zincating aluminum to provide a plated aluminum product having smoothness and dimensional integrity of the aluminum substrate after plating with increased production yield of the plated products.

2. Description of Related Art

Metal plating of metals such as aluminum is of considerable commercial interest. One application, for example, is the preparation of aluminum substrate memory disks which are used in a variety of electronic applications such as computer and data processing systems. Aluminum is the preferred substrate for the disk although other suitable metals may be employed. The metal plating process for metals such as aluminum requires a lengthy and costly pretreatment process to prepare the aluminum surface for plating. The following will be directed to aluminum although it will be appreciated that other metals such as aluminum alloys, aluminum composites (e.g., containing boron carbide particles) may also be used.

In general in a typical metal plating on aluminum process, the ground aluminum substrate is first cleaned to remove dirt, grease and oils and then etched to provide a substrate surface suitable for adhesion of the zincate coating. The etched substrate is then desmutted with nitric acid to remove surface aluminum oxide and the aluminum substrate is then zincated followed by metal plating. For memory disks, an electroless paramagnetic nickel plating layer is plated and then finished with a sputtered cobalt or other magnetic layer. A double zincate procedure is typically used wherein a first zincate layer is stripped using nitric acid and then a second zincate layer applied to the aluminum substrate. The aggressiveness of the solutions used in the conventional process attacks the aluminum substrate and typically adversely affects the dimensional integrity and increases the surface roughness of the substrate and formed plated product.

Another problem associated with current metal plating on aluminum manufacturing processes is caused by the grinding process which is used to smoothen the aluminum substrate. During the grinding process cleaning agents are usually left on the substrate surface. The ground substrate is then typically annealed and the cleaning agents left on the surface tend to react with intermetallics within the substrate along with air, atmosphere and moisture to form metal oxides. Some of the oxides are not effectively removed by current chemistries and contribute to surface roughness.

As with all industrial processes, it is desired to improve the various steps of the process to enhance the overall efficiency of the metal plating on aluminum process. It is also highly desirable if any of the process steps can be deleted since this directly affects the cost of the process and the time required to complete the metal plating process. The smoothness of the final product may also be improved due to the fewer chemical solutions contacting the aluminum substrate.

For a memory disk application, a paramagnetic sublayer of electroless nickel phosphorus (ENP) is plated on the zincated aluminum and is used as the base for a thin layer of ferromagnetic material, i.e., Co, CoNiCr, etc. which is usually applied by sputtering. ENP deposits in excess of about 9% by weight phosphorus are paramagnetic as plated but these deposits lose their amorphous structure and become ferromagnetic above about 290° C. Elevated temperatures on the order of 310° C. can be reached during the sputtering process and at increasing temperatures even more thermally stable ENP deposits are required. By "ENP" is meant herein to be a electroless nickel deposit containing greater than about 9% by weight phosphorus but the invention is applicable to the metal plating of zincated aluminum substrates using other metals such as copper and the like.

The memory disk industry requires that the ENP deposit remain substantially nonmagnetic, e.g., less than 5 gauss ( 0.4 emu/cc) and preferably at its original level of less than 2 gauss ( 0.2 emu/cc) because if the deposit is ferromagnetic it would interfere with the read/write modes by diluting the signal and increasing noise levels.

This requirement has received attention in the industry and a number of articles have been written addressing enhancing the paramagnetic properties of the plated ENP by modifying the ENP bath or alloy composition. An improved method for depositing thermally stable ENP paramagnetic coatings is disclosed in U.S. Pat. No. 5,437,887, assigned to the assignee of the present application. Effective amounts of antimony and/or cadmium are used in the electroless nickel bath to provide the enhanced thermal properties.

While paramagnetic thermal stability of an ENP film is needed in the fabrication of memory disks, the demands of industry for memory disks and other metal plated zincated aluminum substrates have been changing resulting in even more stringent requirements for aluminum metal platers. The surface roughness of the metal plating is always important for a plater and is an especially important consideration in memory disks to achieve high magnetic density wherein more memory can be obtained for the same surface area for a smoother surface memory disk than for a rougher surface. Similarly, metal plated smoothness is likewise important for many products such as compressor vanes and electrical connectors.

For example, the aluminum substrate used to make memory disks previously had a roughness of about 1500 Å. Aluminum substrates are now ground to a surface roughness of about 60 Åor lower before fabrication into a memory disk. It is desired to maintain this low surface roughness in the formed ENP plated memory disk product, but as noted above, the disk manufacturing process involves an extensive pretreatment process to prepare the aluminum surface for plating. The pretreatment process typically roughens the surface due to aggressive etchants and/or zincating solutions which deposit thick, uneven zincate deposits.

Bearing in mind the problems and deficiencies of the prior art, it is an object of the present invention to provide a method for metal plating of zincated aluminum substrates.

Another object is to provide a method for fabricating aluminum substrate memory disks in which an electroless nickel-phosphorous (ENP) paramagnetic layer plated on the zincated aluminum has enhanced paramagnetic thermal stability due to the pretreatment of the disk.

Another object of the present invention is to provide metal plated aluminum substrates including memory disks fabricated using the method of the invention.

In a further object of the present invention a non-aggressive low aluminum etch method is provided for etching aluminum substrates, including aluminum substrates used for memory disks, to prepare the surface for zincating.

Another object of the present invention is to provide a non-aggressive low aluminum etch composition for etching an aluminum substrate, including, an aluminum substrate used for memory disks, to prepare the surface for zincating.

Another object of the present invention is to provide etched aluminum substrates made using the etching method of the invention which substrates are ready for zincating.

It is an additional object of the present invention to provide a method for zincating an aluminum substrate, including an aluminum substrate used for memory disk fabrication.

Another object of the present invention is to provide a composition for zincating an aluminum substrate including aluminum substrates used for memory disk fabrication to prepare the aluminum substrate for metal plating.

It is a further object of the invention to provide a zincating composition and method which provides enhanced smoothness and dimensional integrity of the aluminum substrate after plating with increased production yield of the plated product.

Another object of the present invention is to provide aluminum substrates, including aluminum substrates used for memory disk fabrication, made using the method and zincating composition of the invention.

Other objects and advantages will become apparent from the following detailed description.

For convenience, the following description will be directed to the metal plating of aluminum substrates, double zincating of aluminum substrates and electroless nickel phosphorous plating baths although it will be clear to those skilled in the art that other suitable metals and metal plating baths may be employed using the etchant and zincating compositions and methods of the invention to make metal plated aluminum substrate articles, including memory disks.

SUMMARY OF THE INVENTION

The above and other objects, which will be apparent to those skilled in the art, are achieved by the present invention, which, in a first aspect, relates to a method for metal plating aluminum substrates comprising:

contacting a cleaned and etched aluminum substrate for an effective time with an aqueous zincating composition to form a zincate coating on the aluminum substrate, the zincate composition comprising, in g/l:

NaOH in an amount of about 50 to saturation, preferably 100 to 170, and most preferably 120 to 160;

ZnO in an amount of about 5 to 50, preferably 10 to 30, and most preferably 10 to 15;

a chelator; preferably Rochelle salt, in an effective chelating amount, e.g., about 5 to 200, preferably 20 to 100, and most preferably 65 to 85;

$NaNO_3$ in an amount of about 0.01 to 10, preferably about 1 to 10, and most preferably 1 to 3; and $Fe^{+3}$ in an amount of about 0.15 to 0.5, preferably 0.2 to 0.4 and most preferably 0.2 to 0.3, e.g., 0.26; and metal plating the zincated aluminum substrate with a metal plating bath, for example, an electroless nickel phosphorous bath to form a paramagnetic nickel phosphorous deposit on the zincated surface.

In a further aspect of the invention, the above method for metal plating aluminum substrates is modified by using a double zincate procedure wherein after the first zincating step, the zincated layer is removed by using an acid such as nitric acid and then the stripped aluminum substrate is again contacted with an aqueous zincate composition to form a zincated aluminum substrate surface. It is preferred to use the zincating bath of the invention for both zincating steps. It is this zincated aluminum surface which is then metal plated.

In a further aspect of the invention, the above method for metal plating aluminum substrates is improved by using a special etching composition to remove the surface oxides and etch the surface of the substrate. The preferred etching solution comprises, by volume %:

$HNO_3$ in an amount of about 2 to 12; preferably 5 to 8;

$H_2SO_4$ in an amount of about 1 to 15; preferably 2 to 6; and $H_3PO_4$ in an amount of about 1 to 10; preferably 2 to 4.

In a further aspect of the invention, metal plated aluminum substrates, e.g., memory disks, are provided which are made using the above method of the invention using the zincate composition of the invention and/or the etching composition of the invention.

In another aspect of the invention, a method and composition are provided for etching an aluminum substrate, including an aluminum substrate used to fabricate memory disks, to prepare the surface for zincating comprising:

etching an aluminum substrate preferably a cleaned aluminum substrate for an effective time with an etching composition comprising, by volume %:

$HNO_3$ in an amount of about 2 to 12; preferably 5 to 8;

$H_2SO_4$ in an amount of about 1 to 15; preferably 2 to 6; and $H_3PO_4$ in an amount of about 1 to 10; preferably 2 to 4.

In a further aspect of the invention, etched aluminum substrates are provided which are made using the etching method and etching composition of the invention.

In another aspect of the invention, a method and composition are provided for zincating an aluminum substrate, including an aluminum substrate used to fabricate memory disks, comprising:

contacting a cleaned and etched aluminum substrate for an effective time with an aqueous zincating composition to form a zincate coating on the aluminum substrate, the zincate composition comprising, in g/l:

NaOH in an amount of about 50 to saturation, preferably 100 to 170, and most preferably 120 to 160;

ZnO in an amount of about 5 to 50, preferably 10 to 30, and most preferably 10to 15;

a chelator, preferably Rochelle Salt, in an effective chelating amount, e.g., about 5 to 200, preferably 20 to 100, and most preferably 65 to 85;

NaNO3 in an amount of about 0.01 to 10, preferably about 1 to 10, and most preferably 1 to 3; and $Fe^{+3}$ in an amount of about 0.15 to 0.5, preferably 0.2 to 0.4, most preferably 0.2 to 0.3, e.g., 0.26.

In another aspect of the invention, aluminum substrates are provided which have been zincated using the zincate method and zincate solution of the present invention.

DESCRIPTION OF THE PREFERRED EMBODIMENT(S)

The single, double and triple zincate methods for preparing aluminum for metal plating are well-known in the art. In general, any aluminum or aluminum alloy may be treated using the method and compositions of the invention. The aluminum may be wrought or cast. Aluminum alloys for memory disks are typically wrought and include 5D86 and FFX C276.

While the specific zincate and double-zincate pretreatment methods employed to metal plate aluminum may vary according to the alloys treated and the desired results, a typical zincating procedure used in industry is as follows and it should be understood that water rinses are generally employed after each processing step.

The first step is usually to clean the aluminum surface of grease and oil and any suitable alkaline or acid nonetch cleaner may be employed. Suitable cleaners are nonsilicated mildly alkaline cleaners and a silicated mildly alkaline cleaner both of which are used over a temperature range of about 49° to 66° C. for 1 to 5 minutes.

Etching of the cleaned aluminum substrate is then performed using conventional etchants. It is a highly preferred feature of the invention, however, that the etching composition of the invention be used. The conventional etchants are either acidic or alkaline. The acid etchant is generally preferred particularly when surface dimensions, tolerances and substrate integrity are important. The etchants are generally used at elevated temperatures of about 49° to 66° C. for 1 to 3 minutes.

The etchant solution composition of the invention comprises, by volume %:

$HNO_3$ in an amount of about 2 to 12; preferably 5 to 8;

$H_2SO_4$ in an amount of about 1 to 15; preferably 2 to 6; and $H_3PO_4$ in an amount of about 1 to 10; preferably 2 to 4.

Desmutting of a memory disk aluminum alloy is then conventionally performed using a $HNO_3$ solution (for example 50% by volume) or mixtures of $HNO_3$ and $H_2SO_4$. A typical desmutting solution for other aluminum alloys contains 25% by volume $H_2SO_4$ 50% by volume $HNO_3$ and $NH_4F_4$ and is generally used at 25° C. for 1 –2 minutes.

It is an important feature of the invention that desmutting of the aluminum substrate need not be performed when the etchant composition of the invention is used to etch the aluminum substrate. It has also been found that use of the etchant composition of the invention reduces gassing compared to conventional etchants when used to etch the aluminum substrate which is important from both an environmental and safety standpoint. Conventional etchants typically require scrubbers and ventilation equipment because of the amount of gassing.

It is at this point that a zincate coating is applied to the etched (and desmutted if necessary) aluminum substrate by immersion of the aluminum substrate in a zincate bath as described in Saubestre, U.S. Pat. No. 3,216,835. Zincating baths are disclosed in "Immersion Coatings On Aluminum", D. S. Lashmore, pp. 37–41, January 1980; "The Role Of Iron (III) And Tartrate In The Zincate Immersion Process For Plating Aluminum, S. G. Robertson, I. M. Ritchie pp. 799 –804 A.J. Parker Cooperative Research Centre for Hydrometallurgy, Murdock University, Western Australia 6150, Received Apr. 22, 1996; revised Jul. 30, 1996; and "Formation of Immersion Zinc Coatings on Aluminum", W. G. Zelley, pp. 328–333, paper was prepared for delivery before the Montreal Meeting, Oct. 26 to 30, 1952.

The zincate bath of the invention comprises an alkali metal hydroxide (e.g., NaOH), a zinc salt (such as zinc oxide, zinc sulfate, etc.), preferably ZnO, a chelator preferably Rochelle Salt, $NaNO_3$ and $Fe^{+3}$, usually provided from a $FeCl_3$ salt. $FeSO_4$ and $Fe_2(SO_4)_3$ and other suitable salts may also be used.

It has been found that when the zincate composition of the invention is used the paramagnetic thermal stability of an electroless nickel phosphorous coating applied on the zincate coating is enhanced. While not wishing to be bound by any theory, it is hypothesized that the combination and concentration of components in the bath provides in concert the enhanced paramagnetic thermal stability effect. Accordingly, $NaNO_3$ used in combination with a chelating agent such as Rochelle Salt and controlled amounts of $Fe^{+3}$ ions provides the enhanced effects. Prior art zincating baths employing larger amounts of ferric ion such as disclosed in Zelley, supra, are not suitable for use as the zincating bath of the invention. It has been found that the ferric ion should be employed in an amount of less than the 0.7 g/l of Zelley, typically in an amount less than 0.5 g/l such as 0.15 to 0.5 g/l, preferably, 0.2 to 0.4 and most preferably 0.2 to 0.3, e.g., 0.26. 0.26 is highly preferred because of its demonstrated effectiveness.

The Rochelle Salt is a tartrate containing salt which is preferably used to chelate and solubilize the ferric ion and is employed in excess chelating amounts of about 5 to 200 g/l, preferably 20 to 100 g/l and most preferably 65 to 85 g/l. Other suitable chelators such as acetates, citrates, lactates, maleates and the like may be employed but Rochelle Salt is highly preferred because of its demonstrated effectiveness. The $NaNO_3$ is employed in an amount of about 0.01 to 10 g/l, preferably about 1 to 10 g/l, most preferably 1 to 3 g/l. It has been found that the ferric ion is particularly important to the zincating bath in concert with the $NaNO_3$ to provide the enhanced properties of the zincate film formed by the bath. As noted above, the zincate film provides a base for ENP coating for memory disks having an enhanced paramagnetic thermal stability. The zincating bath of the invention is additionally a non-aggressive bath and maintains the smoothness and dimensional integrity of the aluminum substrate surface. The bath has been also found to have a long operating life and to provide good metal coating adhesion. A further additional feature of the zincating bath is that the bath may be used with any aluminum substrate and still provide the enhanced effects of the bath. The zincating bath of the invention has been found to provide a higher production yield of acceptable metal plated aluminum substrates when used with the etching composition of the invention.

Generally, the double zincate process involves immersion of the aluminum substrate in a dilute zincate bath for a period of preferably 35–60 seconds followed by a thorough cold water rinse, a zincate stripping operation in nitric acid, e.g., 50% by volume, for 1 minute at 25° C., a further cold water rinse, and a second zincate immersion in the bath for about preferably 15–90 seconds at 25° C. and a subsequent water rinse. For memory disks the second zincate bath is used for about 15–40 seconds.

The nitric acid solution used to strip the first zincate coating is generally a 50% by volume solution with a range of concentration being generally about 350 to 600 g/l, and preferably about 450 to 550 g/l. The nitric acid solution may or may not contain ferric ions as shown in U.S. Pat. No. 5,141,778 and may be employed at any suitable temperature, usually about 20° to 25° C. or higher and preferably 21° to 23° C. Immersion times may vary from about 30 to 90 seconds and preferably about 40 to 60 seconds.

While any suitable metal may now be plated on the zincate coated aluminum, the following description will be specifically directed to a paramagnetic electroless nickel phosphorous coating because of its commercial importance for fabricating memory disks.

Electroless nickel plating compositions for applying the nickel coatings are well known in the art and plating processes and compositions are described in numerous publications such as U.S. Pat. Nos. 2,935,425; 3,338,726; 3,597,266; 3,717,482; 3,915,716; 4,467,067; 4,466,233 and 4,780, 342. Other useful compositions for depositing nickel and its alloys are disclosed in the Metal Finish Guidebook and Directory Issue 1992, Vol. 90, No. 1A, pages 353–361. Each of the foregoing patents and publications are included herein by reference.

In general, ENP deposition solutions comprise at least four ingredients dissolved in a solvent, typically water. They are (1) a source of the nickel ions, (2) a hypophosphite reducing agent, (3) an acid or hydroxide pH adjuster to provide the required pH and(4) a complexing agent for metal ions sufficient to prevent their precipitation in solution. A large number of suitable complexing agents for ENP solutions are described in the above noted publications. It will be appreciated by those skilled in the art that the nickel, or other metal being applied, is usually in the form of an alloy with the other materials present in the bath. Thus, if hypophosphite is used as the reducing agent, the deposit will contain nickel and phosphorus. Similarly, if an amine borane is employed, the deposit will contain nickel and boron as shown in U.S. Pat. No. 3,953,654, supra. Thus, use of the term nickel includes the other elements normally deposited therewith.

The nickel ion may be provided by the use of any soluble salt such as nickel sulfate, nickel chloride, nickel acetate and mixtures thereof. The concentration of the nickel ion in solution may vary widely and is about 0.1 to 60 g/l, preferably about 2 to 50 g/l, e.g., 4 to 10 g/l.

The reducing agent, especially for memory disks, is preferably the hypophosphite ion which may be supplied to the bath by any suitable source such as sodium, potassium, ammonium and nickel hypophosphite, sodium hypophosphite is preferred. The concentration of the reducing agent is generally in excess of the amount sufficient to reduce the nickel in the bath. Generally 10–30 g/l of the hypophosphite ion supplied as the sodium salt.

The ENP baths are usually acid with the pH of the bath being about 4 to 6 with 4.2–4.8 being preferred.

The complexing agent may be selected from a wide variety of materials such as those containing anions such as acetate, citrate, glycollate, lactate, maleate, pyrophosphate, tartrate and the like, with mixtures thereof being suitable. Ranges for the complexing agent, based on the anion, may vary widely, for example, about 1 to 300 g/l, preferably about 5 to 50 g/l.

The electroless nickel plating baths may also contain other ingredients known in the art such as buffering agents, bath stabilizers, rate promoters, brighteners, etc.

The present invention is directed to pretreatment of the aluminum substrate using the method and pretreatment compositions of the invention and then to use a plating bath such as an ENP plating bath to plate the pretreated substrate. For memory disks, an ENP bath containing antimony ions and/or cadmium ions in an amount of about 0.1 to 20 ppm or higher is preferably used to plate a thin thermal paramagnetic stable ENP coating, or even the desired thickness coating, on the zincated aluminum substrate as shown in U.S. Pat. No. 5,437,887, supra.

It has been found that the process of the invention provides an ENP plated aluminum substrate in which the ENP will have enhanced retention of its original paramagnetic properties after exposure to heating such as in sputtering operations which coat the disk with a finish layer of cobalt or other magnetic material. It is important that the ENP plating remain substantially paramagnetic and, in particular, that the completed metallized aluminum substrate article retain its desired magnetic properties at temperatures above 290° C., typically about 300 to 315° C. for exposure times up to about 12 minutes, typically about 5 to 10 minutes.

As noted above, the zincate coated aluminum part may be plated with any suitable metal plating bath such as an electroless nickel or copper bath to the desired final thickness. Preferably, the part is immersed in a metal plating bath to plate a thin (strike) coating adequate to provide a suitable base for the thick deposits of the final metal plate using a different electroless nickel bath. Thicknesses for the thin base coating typically range up to about 3 microns or higher, with 1.5 to 2.3 microns being preferred. An immersion time of 15 seconds to 15 minutes usually provides the desired coating depending on bath parameters. A temperature range of about 20° C. to boiling, e.g., 82–93° C., may be employed. A preferred range is about 85 to 89° C. For memory disks, a strike coating is typically not used.

When a strike coating is used, the next step is to complete the nickel plating to the desired thickness and physical characteristics by immersing the nickel coated part in another metal plating bath (which may be any conventional plating bath) which is maintained over a temperature range of about 20° to 100° C., preferably 82° to 93° C., e.g., 85° to 89° C. A thickness up to 130 microns or higher may be employed, with a range of about 12–25 or 50 microns being used for most applications. For memory disks the ENP plating is typically about 10 to 14 microns. When a strike bath process is used, it is preferred not to rinse the strike coated substrate before immersing the substrate in the next plating bath.

It will be appreciated by those skilled in the art that the rate of plating may be influenced by many factors including (1) pH of the plating solution, (2) concentration of reductant, (3) temperature of the plating bath, (4) concentration of soluble nickel, (5) ratio of the volume of bath to the area plated, (6) presence of soluble fluoride salts (rate promoters) and (7) presence of wetting agents and/or agitation, and that the above parameters are only provided to give general guidance for practicing the invention.

It is hypothesized that the thermal paramagnetic stability of the ENP deposit for memory disks and the other advantages of the zincating bath are due to the initial interaction of the aluminum interface with the zincating bath containing $NaNO_3$ and a controlled amount of $Fe^{+3}$ and an effective amount of a chelator, preferably Rochelle salt. This deposit is obtained by preferential displacement of aluminum by zinc with iron co-deposition and the new zincate interface becomes the active zone for ENP deposition. The zinc film provides a protective surface to prevent reoxidation of the aluminum substrate.

The compositions and process of the present invention will now be more fully illustrated by the following specific examples which are illustrative and in no way limitative and wherein all parts and percentages are by weight and temperatures in °C. unless otherwise noted.

EXAMPLE 1

Aluminum substrates were double zincated and plated with an ENP bath using the following comparative procedure (a cold water rinse followed each of the steps):

(1) Immerse in an alkaline cleaner for 5 minutes at 60° C.;

(2) Immerse in an etchant as indicated below for 1 minute at 60° C.;

(3) Immerse in a zincate solution for 38 seconds at 25° C.

(4) Immerse in 50% by volume $HNO_3$ for 1 minute at 25° C.;

(5) Immerse in a zincate solution for 18 seconds at 25° C.;

(6) Immerse in an ENP bath containing, in g/l, 5.8 nickel ions, 22 hypophosphite ions, 3.5 lactic acid, 12 malic acid and additives for 150 minutes at 84°–87° C., (pH 4.3–4.4).

The etchant of the invention was, by volume %, 2.2% $H_3PO_4$, 2.8% $H_2SO_4$ and 6.3% $HNO_3$.

The conventional etchant was, by volume %, 4.5% $H_3PO_4$ and 5.5% and $H_2SO_4$.

The zincating solution was in g/l %, NaOH (144), ZnO (21), Na gluconate (7.5), salicylic acid (6.9) and $Fe^{+3}$ (0.555) and additives.

The plated substrates were evaluated for each etchant and the average results are shown hereinbelow in Table 1. Six measurements were taken per sample and each value is in angstroms.

TABLE 1

| | | Imax | Ia | W max | Wa | R max | Ra |
|---|---|---|---|---|---|---|---|
| Conventional | Mean | 19917 | 66 | 1119 | 42 | 6575 | 43 |
| Etchant | Std. Dev. | 6710 | 2 | 814 | 4 | 4662 | 4 |
| Etchant of the | Mean | 15869 | 39 | 432 | 27 | 2409 | 26 |
| Invention | Std. Dev. | 10922 | 5 | 204 | 3 | 1424 | 7 |

The above values were determined by white light profilometry using a Zygo New View 200 white light profilmeter using a 5$\mu$ bipolar scan, 10× mirau objective with a 2× image zoom.

Imax is Maximum Input.

la is Average Input.

Wmax is Maximum Waviness.

Wa is Average Waviness.

Rmax is Maximum Roughness.

Ra is Average Roughness.

The results show when the etchant method of the invention was used, the average surface roughness of the electroless nickel deposit was 39% lower, the average waviness 35% lower and the average input 41% lower when compared to the use of a conventional etchant.

EXAMPLE 2

Aluminum substrates were sectioned into pieces and treated as follows:

1 ) Immerse in a non-silicated alkaline cleaner for 5 minutes at 60° C.;

2) Immerse in an etchant containing, by vol., 4.5% $H_3PO_4$ and 5.5% $H_2SO_4$ for 1 minute at 60° C.;

3) Immerse in 50% by volume $HNO_3$for 1 minute at 25° C.;

4) Immerse in a zincate bath as indicated below for 36 seconds at 25° C.;

5) Immerse in 50% by volume $HNO_3$ for 1 minute at 25° C.; and

6) Immerse in a zincate bath as indicated below for 15 seconds at 25° C.

TABLE 2

| | Avg Zn Film wt (mg/disk) | Mean ΔRa | Mean ΔWa |
|---|---|---|---|
| Conventional Zincate | 4.3 | 21.25 | 38.50 |
| Zincate of the Invention* | 2.2 | 5.54 | 7.96 |

*In g/l — NaOH (150), Rochelle Salt (80), ZnO (10), $NaNO_3$ (1) and $Fe^{+3}$ (.256) — added as $FeCl_3$.

The conventional zincate bath contained, in g/l, NaOH (144), ZnO(21), Na gluconate (7.5), salicylic acid (6.9) and $Fe^{+3}$ (0.555) and additives.

The results show a thinner, smoother and less wavy zincate deposit for aluminum substrates zincated using the zincate composition of the invention.

EXAMPLE 3

Aluminum substrates were sectioned into pieces and treated as follows:

1) Immerse in a non-silicated alkaline cleaner for 5 minutes at 60° C.;

2) Immerse in an etchant containing, by vol., 4.5% $H_3PO_4$and 5.5% $H_2SO_4$ for 1 minute at 60° C.;

3) Immerse in 50% by volume $HNO_3$for 1 minute at 25° C.;

4) Immerse in a zincate bath as indicated below for 36 seconds at 25° C.;

5) Immerse In 50% by volume $HNO_3$ for 1 minute at 25° C.; and

6) Immerse in a zincate bath as indicated below for 15 seconds at 25° C.

7) Plate in an ENP bath containing, in g/l, 6 nickel ions, 30 hypophosphite ions, 4.5 succinic acid, 24 malic acid and 11 lactic acid and additives for 150 minutes at 88° C. (pH 4.2). ½ of the parts were plated.

A ½ factorial statistical procedure was performed for a total of 32 experiments. The composition of the zincate bath varied as follows (in g/l):

| | High | Low |
|---|---|---|
| Rochelle Salt | 75 | 25 |
| *$Fe^{+3}$ | 0.42 | 0.21 |
| NaOH | 220 | 135 |
| ZnO | 30 | 10 |
| Salicyclic Acid | 13 | 0 |
| Sodium Nitrate | 1 | 0 |

*Added as $FeCl_3.6H_2O$

The average roughness (Ra) of the second zincate coating and the average roughness (Ra) of the plated substrate were both determined by white light profilometry using a Zygo New View 200 white light profilmeter using a 5$\mu$ bipolar scan 1, 10× micrau objective with a 2× range zoom.

The results show the need for sodium nitrate in the zincate bath with the smoothness of the zincate coating being greater than 50% smoother than when sodium nitrate is absent from the bath. Likewise, higher levels of Rochelle salt are desired for increased smoothness of the zincate coating as well as increased smoothness of the metal plating. $Fe^{+3}$ is preferred in the bath at levels between 0.2 and 0.4 g/l to provide a smooth metal plating.

EXAMPLE 4

Aluminum substrates were double zincated and plated with an ENP bath using the following comparative procedure (a cold water rinse followed each of the steps):

(1) Immerse in an alkaline cleaner for 5 minutes at 60° C.;

(2) Immerse in an etchant containing, by volume, 2.2% $H_3PO_4$, 2.8% $H_2SO_4$ and 6.3% $HNO_3$ for 1 minute at 60° C.;

(3) Immerse in a zincate solution as indicated below for 38 seconds at 25° C.;

(4) Immerse in 50% by volume $HNO_3$ for 1 minute at 25° C.;

(5) Immerse in a zincate solution as indicated below for 18 seconds at 25° C.;

(6) Immerse in an ENP bath containing, in g/l, 5.8 nickel ions, 22 hypophosphite ions, 3.5 lactic acid, 12 malic acid and additives for 150 minutes at 84°–87° C., (pH 4.34.4).

Zincate solution A of the invention contained, in g/l, 135 NaOH, 10 ZnO, 75 Rochelle salt, 1 $NaNO_3$ and 0.206 $Fe^{+3}$.

Zincate solution B of the invention contained the same as solution A except for the amount of $Fe^{+3}$ which was 0.306 $Fe^{+3}$.

Adhesion tests were performed on the substrates by (1) scribing a cross-hatch applying tape and pulling the tape; (2) bending 180°, applying tape and pulling the tape; and (3) a band saw cut, applying tape and a perpendicular tape pull.

The samples zincated in zincate solution A passed test 3 but developed loss of adhesion on tests 1 and 2. The samples zincated in zincate solution B passed all three tests showing the enhanced effect of $Fe_{+3}$ on adhesion at the higher level of 0.306.

EXAMPLE 5

Aluminum substrates were metal plated as follows:

1) Immerse in a cleaner for 3 minutes at 60° C.;
2) Immerse in an etchant containing, by vol., 4.5% $H_3PO_4$and 5.5%-$H_2SO_4$ for 1 minute at 60° C.;
3) Desmut in 50% by volume $HNO_3$ for 1 minute at 25° C.;
4) Immerse in a zincate composition as indicated below for 38 seconds at 25° C.;
5) Immerse in 50% by volume $HNO_3$ for 1 minute at 25° C.;
6) Immerse in a zincate composition as indicated below for 18 seconds at 25° C.; and
7) Plate with an electroless nickel phosphorous bath containing, in g/l, 5.8 nickel ions, 22 hypophosphite ions, 3.5 lactic acid, 12 malic acid and additives for 135 minutes at 88° C. (pH 4.48).

The results are as follows:

TABLE 3

| | USM (emu/cc) | |
|---|---|---|
| | As Plated | 310° C./1 hour |
| Conventional Zincate | 0.1348 | 0.1236 |
| Zincate of the Invention* | 0.0836 | 0.0986 |

*In g/l — NaOH (150), Rochelle Salt (80), ZnO (10), $NaNO_3$ (1) and $Fe^{+3}$ (.256) — added as $FeCl_3$.

The conventional zincate both contained, in g/l, NaOH (144), ZnO(21), Na gluconate (7.5), salicylic acid (6.9) and $Fe^{+3}$ (0.555) and additives.

The results show the enhanced paramagnetic properties of an ENP plated aluminum substrate as plated and at an exposure of 310° C. for one hour when zincated using a zincate bath of the invention. Similar enhanced paramagnetic properties were obtained at 300° C. and 290° C. for periods up to 1 hour. $Fe^{+3}$ levels in the conventional bath of 0.555 g/l indicate higher paramagnetic properties.

EXAMPLE 6

Example 5 was repeated on a commercial metal plating production line except that the aluminum substrates zincated using the zincate composition of the invention were also etched using an etchant of the invention containing, by volume, 2.2% $H_3PO_4$, 2.8% $H_2SO_4$ and 6.3% $HNO_3$. The production yield using the conventional process was 71%. This is to be contrasted with a production yield using the method of the invention of 84%.

While the invention has been illustrated and described in what are considered to be the most practical and preferred embodiments, it will be recognized that many variations are possible and come within the scope thereof, the appended claims therefore being entitled to a full range of equivalents.

Thus, having described the invention, what is claimed is:

1. A method for metal plating aluminum to provide a metal coating having thermal retention of paramagnetic properties when metal plated with a paramagnetic metal coating comprising:

contacting a cleaned and etched aluminum substrate for an effective time with an aqueous zincating composition to form a zincate coating on the aluminum substrate, the zincate composition comprising, in g/l:
NaOH in an amount of about 50 to saturation;
ZnO in an amount of about 5 to 50;
$Fe^{+3}$ in an amount of about 0.15 to 0.5;
a chelator in an amount effective to chelate the $Fe^{+3}$; and
$NaNO_3$ in an amount of about 0.01 to 10; and
metal plating the zincated aluminum substrate.

2. The method of claim 1 wherein after the zincating step, the zincate coating is contacted with nitric acid and then contacted again with the zincating composition for an effective time to form the zincate coating on the aluminum substrate.

3. The method of claim 1 wherein the chelator is Rochelle Salt.

4. The method of claim 3 wherein the zincating composition comprises, in g/l, about 100 to 170 NaOH, 10 to 30 ZnO, 20 to 100 Rochelle Salt, 1 to 10 $NaNO_3$ and 0.2 to 0.3 $Fe^{+3}$.

5. The method of claim 4 wherein the aluminum substrate is etched using an etching solution comprising, by volume %, $HNO_3$ in an amount of about 2 to 12;
$H_2SO_4$ in an amount of about 1 to 15; and
$H_3PO_4$ in an amount of about 1 to 10.

6. The method of claim 1 wherein the zincated aluminum substrate is metal plated using an electroless nickel phosphorus bath to form a paramagnetic nickel phosphorus metal plating containing greater than about 9% phosphorus by weight on the zincate coating.

7. The method of claim 5 wherein the etching solution comprises, by volume percent, $HNO_3$ in an amount of about 5 to 8; $H_2SO_4$ in an amount of about 2 to 6; and $H_3PO_4$ in an amount of about 2 to 4.

8. A method for zincating an aluminum substrate comprising:

contacting a cleaned and etched aluminum substrate for an effective time with an aqueous zincating composition to form a zincate coating on the aluminum substrate, the zincate composition comprising, in g/l:
NaOH in an amount of about 50 to saturation;
ZnO in an amount of about 5 to 50;
$Fe^{+3}$ in an amount of about 0.15 to 0.5;
a chelator in an amount effective to chelate the $Fe^{+3}$; and
$NaNO_3$ in an amount of about 0.01 to 10.

9. The method of claim 8 wherein the chelator is Rochelle Salt.

10. The method of claim 9 wherein the zincating composition comprises, in g/l, about 100 to 170 NaOH, 10 to 30 ZnO, 20 to 100 Rochelle salt, 1 to 10 $NaNo_3$ and 0.2 to 0.3 $Fe^{+3}$.

* * * * *

UNITED STATES PATENT AND TRADEMARK OFFICE

CERTIFICATE OF CORRECTION

PATENT NO. : 6,080,447

DATED : June 27, 2000

INVENTOR(S) : Ferroni et al.

It is certified that error appears in the above-identified patent and that said Letters Patent is hereby corrected as shown below:

Column 2, line 45, delete "Åor" and substitute therefor - - Å or - - .

Column 4, line 45, delete "10to" and substitute therefor - - 10 to - - .

Column 10, line 56 delete "$_{2.8}$" and substitute therefor - - 2.8 - - .

Column 10, line 67 delete "4.34.4) and substitute therefor - - 4.3 - 4.4) - - .

Column 11, line 62, delete "$_{2.8}$" and substitute therefor - - 2.8 - - .

Signed and Sealed this

First Day of May, 2001

*Attest:*

Nicholas P. Godici

NICHOLAS P. GODICI

*Attesting Officer*

*Acting Director of the United States Patent and Trademark Office*